US007131166B2

(12) United States Patent
Cohen et al.

(10) Patent No.: US 7,131,166 B2
(45) Date of Patent: Nov. 7, 2006

(54) MULTIPLE SELF LOCKING HINGE ASSEMBLY

(75) Inventors: Arnold H. Cohen, Andover, MA (US); James Q. Maloy, Clifton, NJ (US); Lori R. Newman, Natick, MA (US); Michael Smith, Passaic, NJ (US)

(73) Assignee: Fulerum Sports, Inc., Clifton, NJ (US)

( * ) Notice: Subject to any disclaimer, the term of this patent is extended or adjusted under 35 U.S.C. 154(b) by 0 days.

(21) Appl. No.: 11/189,366

(22) Filed: Jul. 25, 2005

(65) Prior Publication Data

US 2005/0268430 A1 Dec. 8, 2005

Related U.S. Application Data

(63) Continuation-in-part of application No. 10/695,693, filed on Oct. 29, 2003, now Pat. No. 7,003,849.

(51) Int. Cl.
*B25G 3/18* (2006.01)

(52) U.S. Cl. ..... 16/232; 16/436; 16/438; 16/429; 181/177.1; 403/102

(58) Field of Classification Search ..... 16/232, 16/321, 324, 326, 332, 335, 371, 387, 900, 16/429; 182/163, 164; 5/99.1, 111, 282.1; 15/144.1, 144.3, 144.4; 292/DIG. 63, DIG. 30; 81/177.2, 177.1 X; 403/102, 327; 108/131, 108/132

See application file for complete search history.

(56) References Cited

U.S. PATENT DOCUMENTS

| | | | | |
|---|---|---|---|---|
| 96,777 A | | 11/1869 | Clyde | |
| 793,576 A | | 6/1905 | Follmer | |
| 3,187,373 A | | 6/1965 | Fisher | |
| 3,833,964 A | | 9/1974 | Harcourt | |
| 4,736,490 A | | 4/1988 | Wesselski | |
| 4,773,503 A | | 9/1988 | Purkapile | |
| 4,925,329 A | * | 5/1990 | Chuang | 403/93 |
| 5,139,283 A | | 8/1992 | Dow | |
| 5,288,161 A | * | 2/1994 | Graves et al. | 403/324 |
| 5,615,427 A | * | 4/1997 | Huang | 5/99.1 |
| 5,671,490 A | * | 9/1997 | Wu | 5/426 |
| 5,685,660 A | * | 11/1997 | Liao | 403/102 |
| 5,970,540 A | * | 10/1999 | Cheng | 5/99.1 |
| 6,485,216 B1 | * | 11/2002 | Cheng | 403/102 |
| 6,634,039 B1 | * | 10/2003 | Cheng | 5/99.1 |
| 6,915,545 B1 | * | 7/2005 | Chen | 16/297 |

* cited by examiner

*Primary Examiner*—Brian E. Glessner
*Assistant Examiner*—Mark Williams
(74) *Attorney, Agent, or Firm*—Thomas E. Hagar

(57) ABSTRACT

The present invention is an ingenuously designed multiple self locking hinge assembly that is simple to manufacture and can come in a variety of shapes and sizes given the application requirements. It has few parts making it cost effect and simple to use. The hinge assembly can easily be opened and closed with a single hand while at the same time creating a strong hinge connection. The invention can be used in a number of applications, including use with multiple poled devices for many common applications such as crutches, walkers, golf bag and baby carriages to name a few. The invention can also be used in conjunction with devices that require a collapsible frame. The invention also provides lateral strength and stability to a multiple poled device.

15 Claims, 7 Drawing Sheets

MULTIPLE SELF LOCKING HINGE ASSEMBLY

This application is a continuation-in-part of a U.S. application, application Ser. No. 10/695,693, filed on Oct. 29, 2003 now U.S. Pat. No. 7,003,849.

BACKGROUND a) Field of the Invention

This invention relates to the field of folding hinges designed for use in conjunction with devices that use multiple poles or similar means and where it is desirable to easily erect and collapse the same. More specifically, this device is used in conjunction with crutches where the user typically has an injury, is handicapped or otherwise physically challenged; and as such, would desire the convenience of a single hand operation. The device is also applicable with walkers, golf bag carriages, baby carriages, and similar devices. This invention consists of a plurality of self locking hinges connected via a connection means and a linked release mechanism that provides a means to engage and disengage the invention using only a single hand making use of multiple poled and related devices convenient. Presently there is no effective single release multiple poled hinged device in the market place. The present invention fills such a void.

b) Description of the Related Art

The present invention is directed towards folding or collapsible hinges that are designed for use in conjunction with multiple poled or similar devices. The present invention consists of several self locking hinges connected to each other so that a multiple hinged device is created. Presently, there are different folding hinge designs that can be used in conjunction with a single pole or other device to create collapsible frames. However, none of the prior art has a means of connecting two or more hinges in a poled device to make an effective collapsing hinged device. But more critically, none of the prior art, individually or collectively, incorporates all of the novel aspects of the present invention of a simple, inexpensive, yet easy to manufacture, strong self locking set of hinges that can be operated with merely a single hand.

The prior art has several different collapsible hinge designs but those designs have a limitation in that the hinge is designed to work solely as an independent hinge. A common collapsible hinge assembly in the prior art uses spring loaded poles that facilitate both the opening of the hinge assembly and the maintaining of the hinge assembly in a closed position. Some devices do not use an actual hinge at the connection point but rely on the spring loaded, or bungee cord loaded, poles and a sleeve type arrangement where one pole possess a sleeve designed to slide over a second pole. This arrangement is common with poles used to support pop up camping tents and other similar devices. The main draw back is that two hands are required to assemble the two sections of the pole due to the combination of the internal spring mechanism and the overlapping sleeve arrangement. Other devices have an internal spring loaded means, but have many internal parts that make is complicated and costly to manufacture. The hinged portions of the present invention only have three basic parts and are easily manufactured and placed inside a pole without any internal components.

Other devices do not use springs or sleeves, such as U.S. Pat. No. 3,833,964, but use the pole material to create the spring action. This device fails from the shortcoming of not yielding a true end-to-end 180-degree connection desirable for crutch, walker or other devices. Furthermore, this hinge device could be disengaged if one where to apply force to underside of the hinge, a concept not desirable for crutches or walkers. Still other devices utilize a latch mechanism as the present invention. One such example is U.S. Pat. No. 96,777, a device specifically designed for use with an umbrella. This device does not create a straight 180-degree orientation and does not easily collapse down for easy storage. Further, it does not have an offset hinge connection as the present invention preventing the device from being collapsed to a compact sized for easy transport and storage.

Some devices possess an offset hinge pivot connection. An example can be seen in U.S. Pat. No. 5,685,660 and its cited prior art references contained within the patent. All of these references suffer from the common problems of not being able to be engaged or disengaged with a single hand. The cited reference itself does have a push button to release the mechanism but in doing so one's own finger will be holding the press plate of the opposite hinge portion preventing the same from disengaging from the main hinge portion, thereby preventing the device from being a single hand operation. Other devices require an external means to disengage the hinge, for example Cheng, U.S. Pat. No. 5,970,540. The Cheng hinge design can not operated on its own as a self standing hinge but must be incorporated with non hinge elements for it to be operated. To disengage the hinge in the Cheng reference one must hold onto the playpen with one hand while grabbing the floor of the playpen with the other. Lastly and most critically, all of the abovementioned devices are not designed as multiple hinged assemblies.

In sum, the present invention overcomes all the shortcomings of the prior art and discloses a simple self locking hinge assembly. The design is simple to manufacture, can come in a variety of shapes and sizes given the application requirements and has few parts making it cost effect. Due to the unique geometry of its elements and their respective geometric orientation the hinge assembly can be easily opened and closed with a single hand. Neither the unique geometry of the hinge's elements or their respective geometric orientation is seen in the prior art. When closed the hinge assemble creates a strong connection between a multiple of hinges and the respective poles that the hinges are attached. Furthermore, the device has an ingenious means of axially connecting several hinges together so that the hinges can work in unison in a multiple poled device while at the same time not compromising it's single hand operation, neither concept seen in the prior art. Lastly, the invention provides additional lateral strength and stability to a multiple poled device.

SUMMARY OF THE INVENTION

The invention consists of an ingenuously designed set of self locking hinges connected via a connection means. The invention can be used in a number of applications. The hinge can be used in conjunction with poles for many common applications such as crutches, walkers, golf bag carriages, baby carriages, and similar devices. The invention can come in any size and shape depending on the application needs. One key advantage of the invention is that it can be opened and closed with single hand and with one fluid motion. In the case of a crutch a person simply holds the upper half of the crutch containing the handle and releases the bottom half of the crutch. The self locking hinge assembly engages once the bottom half of the crutch is in place, that is, lined up end to end with the top half of the crutch (See FIG. 5 and FIG. 6). The hinge assembly is designed such that the force, typically gravity, which is used to bring the lower half of the crutch in orientation with the top half of the crutch is sufficient to cause the self locking latches to pivot sufficiently to engage the hinge assembly. Although it is not necessary one may wish to manually pivot the self locking latches to engage the hinge assembly without loosing the ability to use the invention as a single hand operation. One can easily disengage the assembly by applying pressure by the finger of one's hand on to the lever causing the self locking latches to pivot and thus disengage the hinge assembly. The single hand operation of the hinge assembly is desirable and convenient in many applications, especially in the case with one using a crutch as one would have an injury and as such he or she may need the convenience of a single hand operation.

Another advantage of the invention is that it allows for a crutch, or other multiple poled devices, to be broken down to a compact size for easy transportation and storage. This is desirable in almost all applications, especially with crutches. If needed several hinge assemblies may be placed in the multiple poled device thereby allowing the device to be folded a number of times, further reducing the size of the device for transport and storage. Lastly, the connection means and the lever of the invention provide a lateral stability and strength to the multiple poled device.

The invention consists of essentially three main pieces; a self locking latch lever, an axially aligning connection means and a plurality of self locking hinges. Each self locking hinge contains three pieces; two hinge portions that are pivotally joined and a self locking spring loaded latch that locks the two hinge portions together. The two hinge portions are designed to be disposed end to end and are pivotally engaged with each other around a pivot pin. The hinge portions are geometrically designed so that they do not protrude beyond the pole diameter. The only exceptions are the lobe portions of the hinge that create an offset pivot point. The offset pivot point allows the poles attached to the hinge to touch and to be parallel when the entire assembly is in its closed position. The third portion of the hinge is the self locking latch which is spring actuated. The self locking latch is permanently attached to top portion of one hinge portion. The self locking latch locks the hinge by engaging a recess or notch in the opposing hinge portion. When engaged the hinge creates a strong connection that is sufficient for its application purposes.

Accordingly, one object of this invention is to provide a self locking hinge assembly that can be easily engaged and disengaged with a single hand.

Another object of this invention is to provide a self locking hinge assembly that can be used in conjunction with a crutch such that the crutch can be folded and unfolded with a single hand, as the same would be a convenience to one using a crutch.

A third object of this invention is to provide a self locking hinge assembly that is simple and inexpensive to manufacture.

A fourth object of this invention is to provide a self locking hinge assembly that can be incorporated with multiple poled devices, or other devices, so that one may possess a poled, or other, device that is strong in nature while being capable of being broken down to a compact size for easy transport and storage.

A fifth object of the invention is to add lateral strength and stability to a multiple poled device.

A sixth object of the invention is to fill the need in the marketplace for an effective multiple hinged assembly.

Other objects and advantages of this invention will become apparent from the following detailed description taken in conjunction with the accompanying drawings.

BRIEF DESCRIPTION OF THE DRAWINGS

These and other features, aspects and advantages of the present invention will become better understood with reference to the following description, appended claims, and accompanying drawings where.

DETAILED DESCRIPTION OF THE PREFERRED EMBODIMENT

Figure 1:
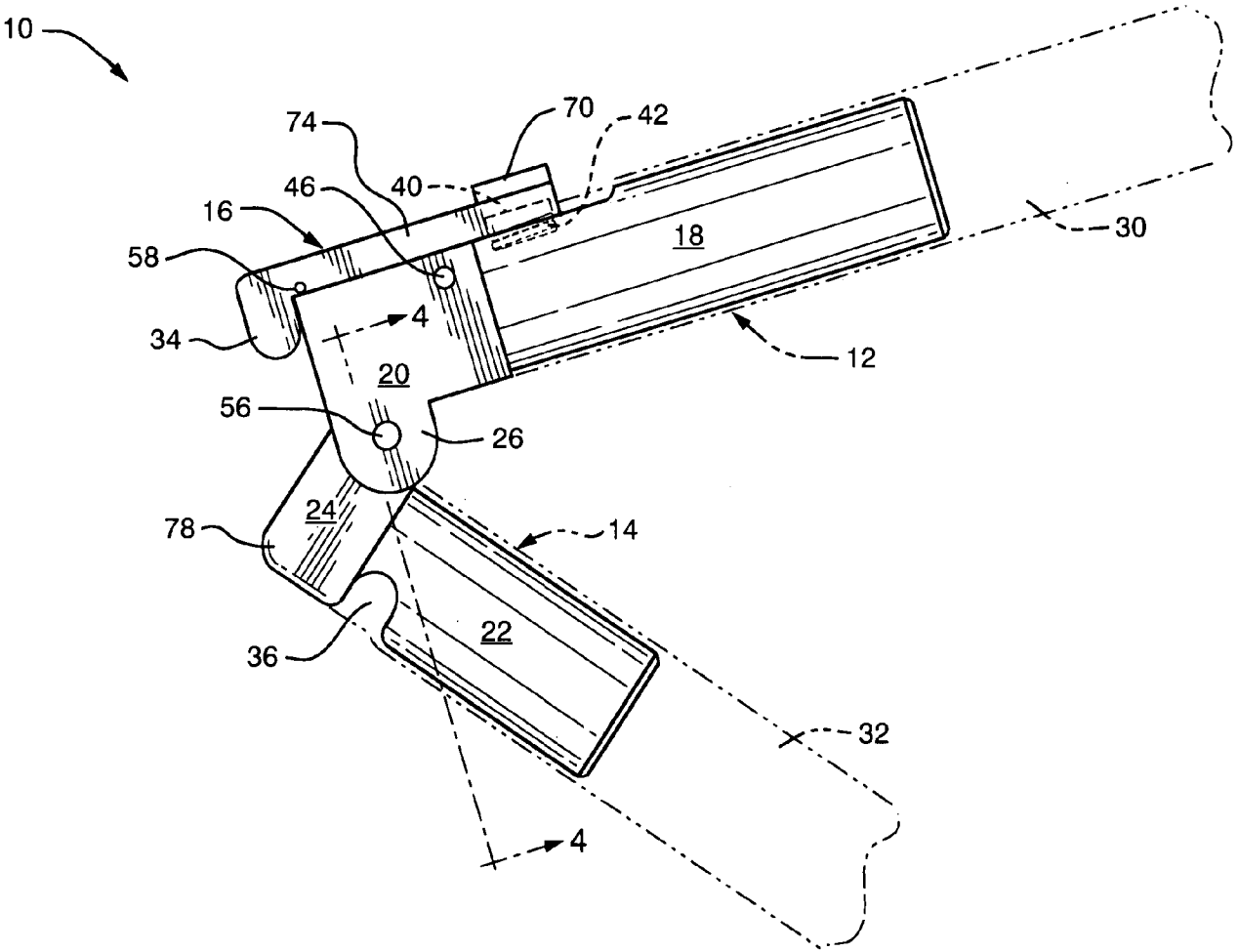
FIG. 1 is a plan view of the invention.
Figure 3:
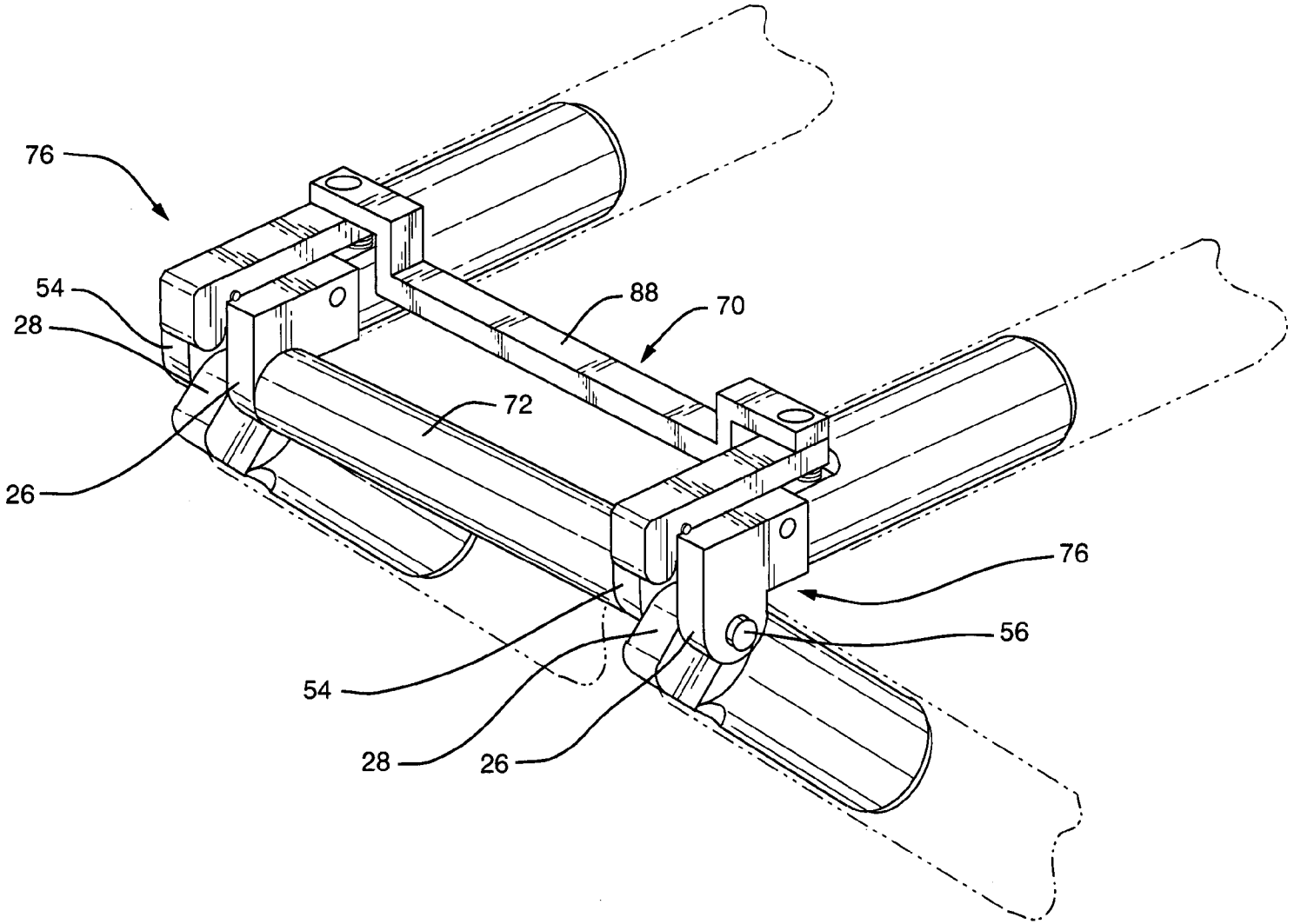
FIG. 3 is a perspective view of the invention.

Referring to the Figures and more specifically FIG. 1 and FIG. 3, the invention 10 consists of essentially three main parts, a lever 70, a connecting device 72 and a plurality of self locking hinges 76. Each self locking hinge 76 itself consists of three main parts, a first hinge portion 12, a second hinge portion 14 and a spring loaded self locking latch 16. Each hinge portion has a main body portion and a connecting portion containing lobes designed to connect the two hinge portions. The first hinge portion 12 has a main body portion 18 and a connecting portion 20 with two lobes 26 and 54. The second hinge portion 14 has a main body portion 22 and a connecting portion 24 with a single lobe 28. The main body portions of the hinge portions are designed to allow the hinge portions to be engaged with poles or other devices. In FIG. 1, the main body portion 18 of first hinge portion 12 is disposed in pole 30 while the main body portion 22 of second hinge portion 14 is disposed in pole 32. The main body portions of the hinges can be made in a variety of geometric shapes so that they can be connected with variety of different shaped poles or devices requiring the invention 10. The preferred embodiment of the invention 10 is to have the main body portions of the hinges cylindrical in shape so that they may be accepted into a hollow cylindrical pole device. The invention 10 can be made in any size depending on the application needs. The parts of the invention 10 can be made from metal. In the preferred embodiment the spring 42 is made from steel, the pin 46 and rod 56 are both made from hardened steel and the remaining parts are made from aluminum. The parts are simple in design and can be made using standard machining techniques.

The lobes 28, 26 and 54 extend from the bottom of their respective connecting portions and are designed to engage each other. The single lobe 28 is designed to be disposed between the two lobes 26 and 54. Each lobe has a hole and when the hinge is assembled all three holes of the lobes are axially aligned with each other. A single rod 56 is disposed within the three holes of the lobes thereby providing a means to connect the lobes and thus connect the hinge portions. Any means known in the art could be incorporated to connect the rod 56 to the three lobes. In a preferred embodiment the rod 56 has a press fit in lobe 28 but only has a rolling fit in lobes 26 and 54 thereby allowing the hinges to pivot (See FIG. 4). In the alternative one could affix the rod 56 to the lobe 28 via a setscrew, adhesive or other securing means.

Figure 5:
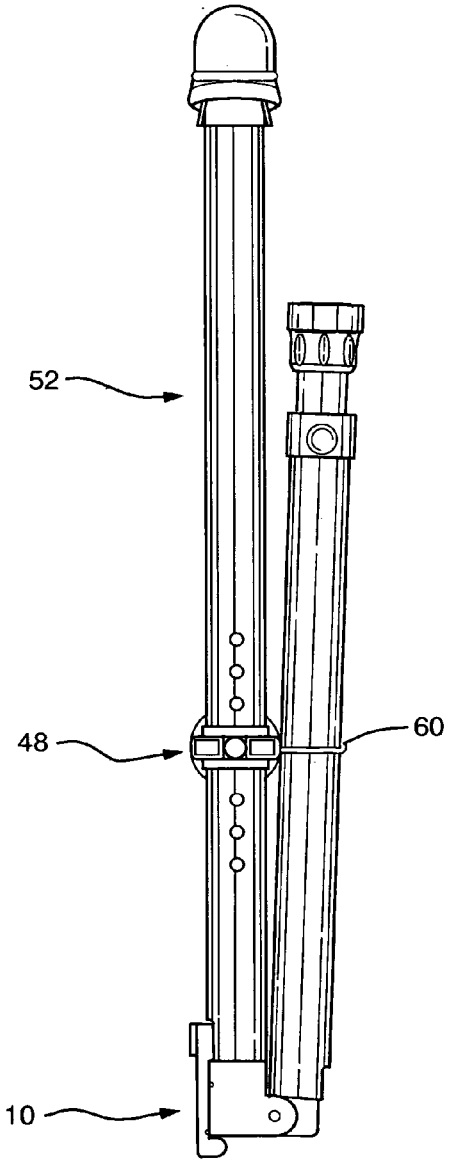
FIG. 5 is an elevation view of the invention in its closed position and used in conjunction with poles for a crutch.
Figure 6:
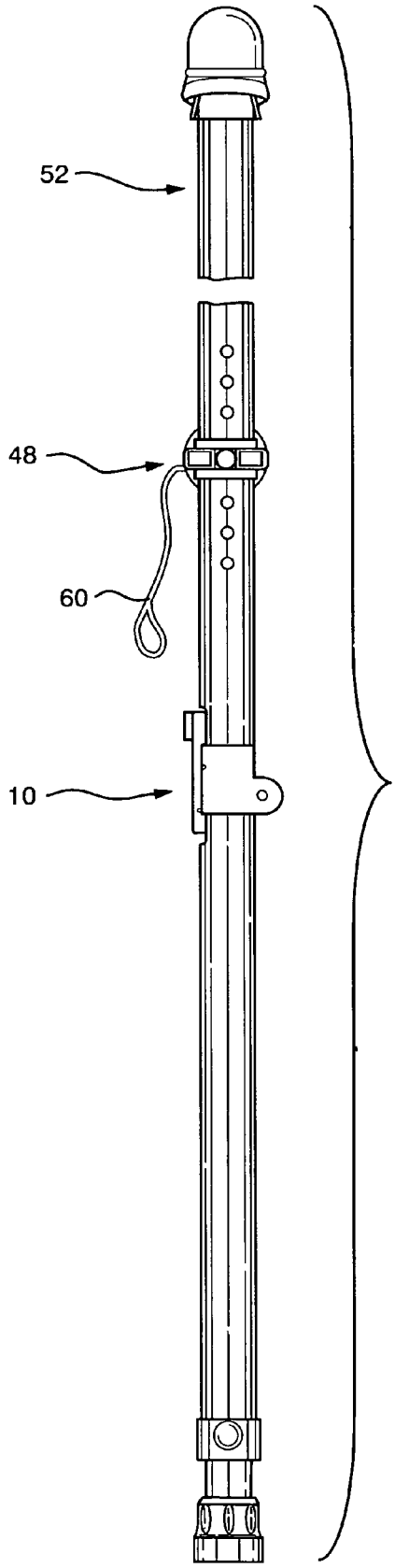
FIG. 6 is an elevation view of the invention in its engaged position and used in conjunction with poles for a crutch.

The pin and lobe connection provides a means to allow the hinge portions to be pivotally joined and allow for the hinge portions to engage and disengage. The lobes protrude from the base of their respective connecting portions and therefore are offset from the main center axis of the hinge portions. In the preferred embodiment the lobes are offset a sufficient distance so as to allow the hinge portions to pivot in a full 180-degree orientation from being parallel to each other to being axially aligned end to end. FIG. 5 and FIG. 6 illustrates the full movement of the invention 10 from its disengaged, or closed, position to its engaged, or open, position, with only the handle 48 of the crutch 52 preventing the hinge portions from being in perfect parallel orientation.

The self locking latch 16 is the part of the invention 10 that locks the two hinge portions together end to end so that a strong connection is made. At the bottom of one end of the self locking latch 16 is a connecting lobe 34 designed to engage a recess 36 in the main portion 22 of the second hinge portion 14. The preferred embodiment is to have the axis of the connecting lobe 34 in a 90-degree orientation with the axis of the main portion 74 of the self locking latch 16. At the opposite end of the self locking latch 16 lever 70 is connected to the top part of the self locking latch 16. The lever 70 is connected to all of the self locking latches of the respective hinges and provides a means to disengage the invention 10 with a single hand. When the lever 70 is pressed down it causes all of the self locking latches to rock and disengage in unison from their respective recesses. The main portion 88 of the lever 70 is disposed between the first hinge portions of each respective hinge. In the preferred embodiment the self locking latch 16 is pivotally connected to the top portion of the main body portion 18 of the first hinge portion 12.

Figure 2:
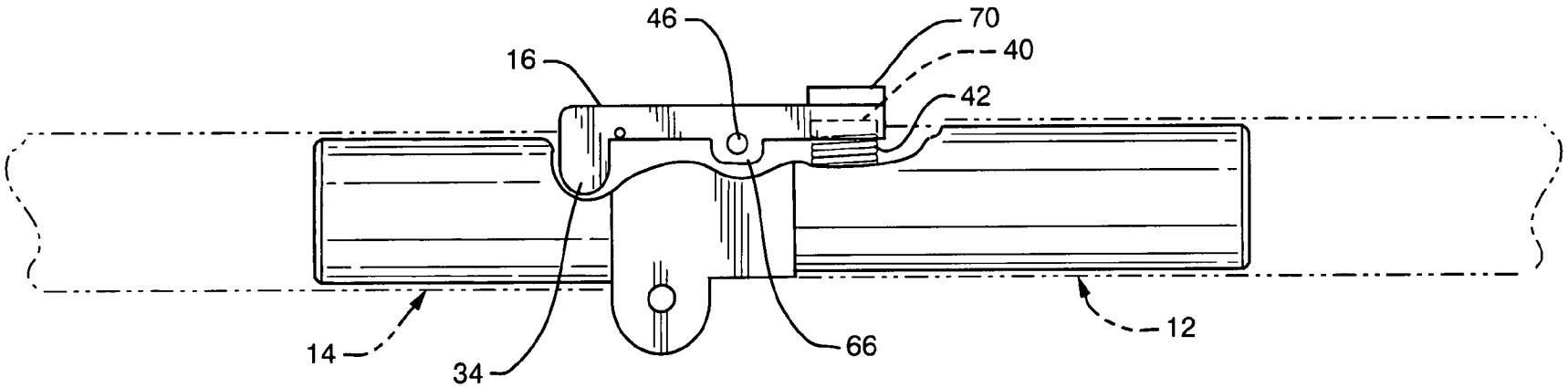
FIG. 2 is a cut away plan view of the invention in its engaged position and showing the self locking latch engaged.

A recess 40 is disposed on the bottom of the self locking latch 16 and directly opposite of where the lever 70 is attached to the self locking latch 16. The recess 40 is designed to accept a spring 42 which itself is disposed within the connecting portion 20 of the first hinge portion 12 (see FIG. 2). The spring 42 is disposed between the main body portion 18 and the recess 40 and provides a means for keeping the self locking latch 16 engaged in the recess 36, and thus the hinge assembly engaged. The compression of the spring 42 created by the downward pressure on the lever 70 provides a means to help release the self locking latch 16 from the recess 36.

Figure 7:
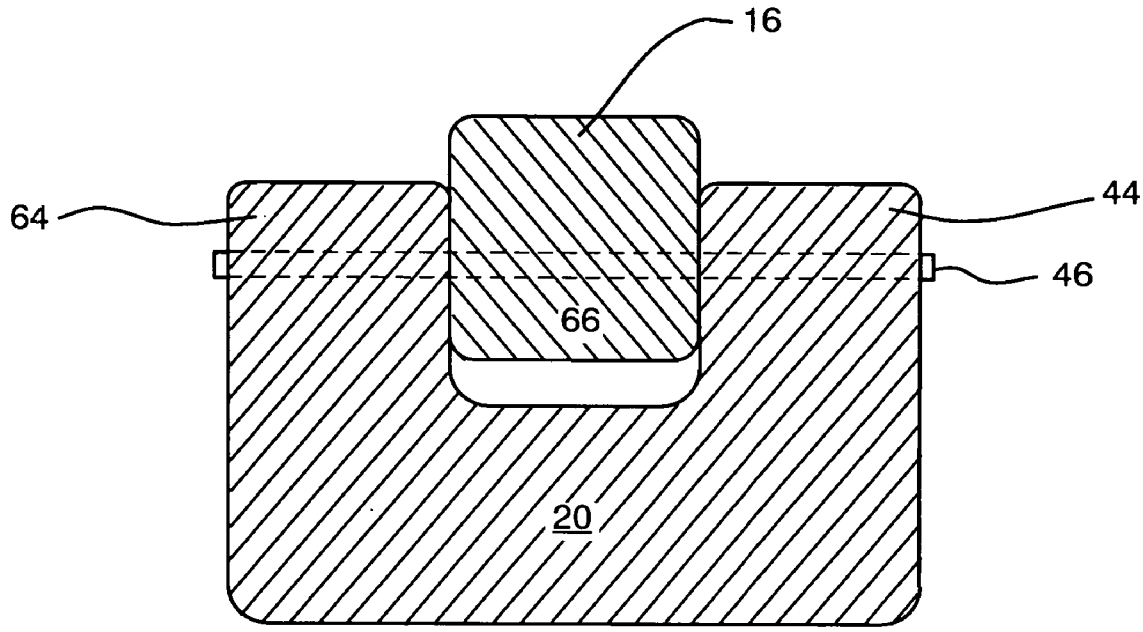
FIG. 7 is cross sectional view of the connection between the self locking latch and the first hinge portion.
Figure 8:
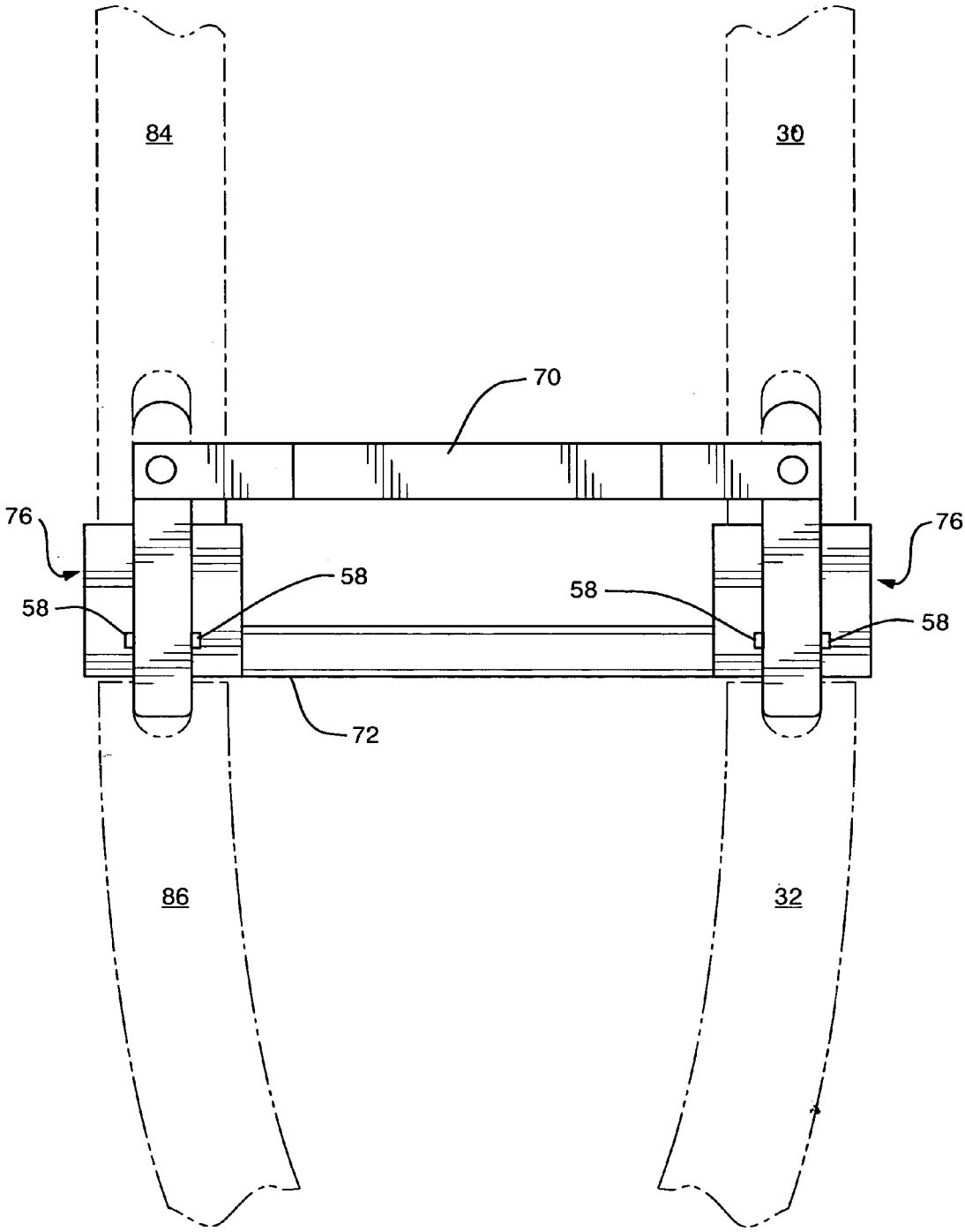
FIG. 8 is a plan view of the invention when used in a crutch.

On the bottom of the self locking latch 16 is a pivot lobe 66 which is designed to engage two pivot lobes 44 and 64 protruding up from connecting portion 20 of the first hinge portion 12 (See FIG. 7). A hole is disposed in all three lobes in such a manner that when the three holes are axially aligned the self locking latch 16 is in place in relation to the top part of the first hinge portion 12. A pin 46 is disposed in holes of the lobes 44, 64 and 66 so that the self locking latch 16 can be connected to the top part of the first hinge portion 12 and provides a means for the self locking latch 16 to move pivotally on top of the first hinge portion 12. This pivot connection in conjunction with the actions of the spring 42 and lever 70 allows the self locking latch 16 to be engaged and be disengaged from recess 36.

Figure 4:
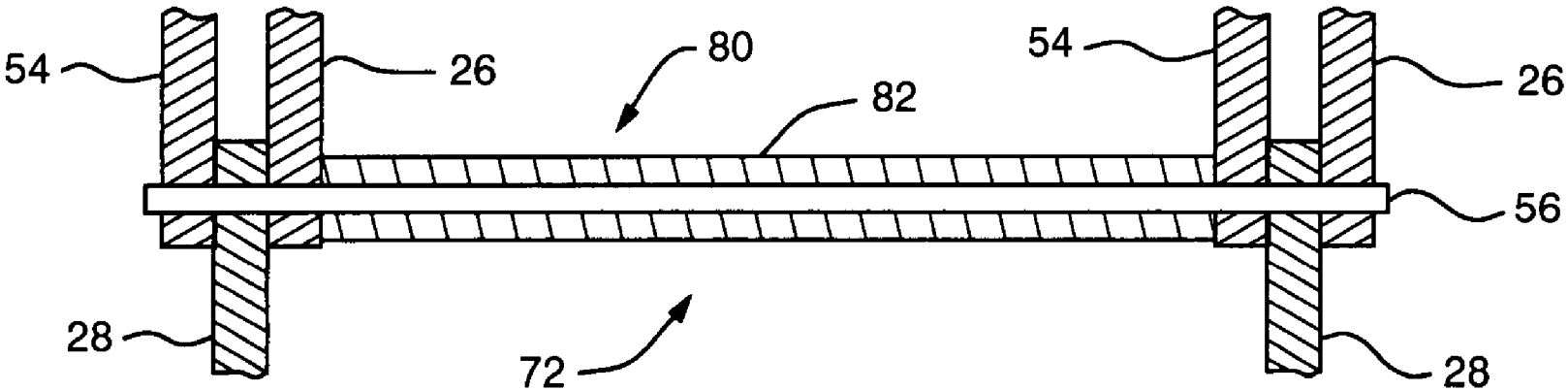
FIG. 4 is a cut away view of the connecting device attached to the hinge portions.

A connecting device 72 is disposed between a set of two self locking hinges and is axially aligned with the holes of the lobes 26, 28 and 54. In FIG. 4.0 one can see the connecting device 72, which in the preferred embodiment is made of two pieces; namely, the rod 56 and a sleeve 80. The rod 56 runs the entire width of the hinge assembly and is the means with which the hinges can be axially aligned and therefore pivot along the same axis. This ability for the hinges to pivot along the same axis is a key concept of invention. Allowing the hinges to pivot on the axis ensures that the hinge assembly will work properly and successfully. The rod 56 can be made from any strong metal material strong enough to maintain the axial alignment of the hinges. In the preferred embodiment the rod 56 is made from hardened steel. The sleeve 80 is made from any strong metal material with the preferred embodiment being aluminum.

A sleeve 80 is disposed over and concentrically aligned with the rod 56 and also is disposed between two hinges. In the preferred embodiment, the sleeve 80 is press fit on to the rod 56. Alternative, the sleeve 80 could be attached to the rod 56 via a setscrew or other means known in the art. If desired, the sleeve 80 could maintain a loose fit over the rod 56 allowing it to spin around the rod 56. The sleeve 80 does maintain a line to line fit against the lobes of the hinge portions thereby allowing free movement of the hinge portions without any resistance from the sleeve 80. The sleeve 80 also allows the hinges to be separated by a constant distance through the pivoting of the hinges, another novel feature of the invention allowing the hinge assembly to work properly and successfully. Also, the line to line fit between the sleeve 80 and the lobes of the hinge portion in conjunction with the lever 70 enhances the lateral stability of the entire hinge assembly and the attached device.

The exterior surface 82 of the sleeve 80 could simply be cylindrical in shape, but any shape would be sufficient. The exterior surface 82 could also be hexagonal, octagonal, or have a cross sectional shape that is square, but the preferred embodiment is cylindrical.

If desired one could make the connecting device 72 from one piece of material. In this particular embodiment a single piece of material is used for the connecting device 72 with each end of the connecting device 72 turned down on a lathe using standard machining techniques to create two rods 56. The hinges portions are then fitted to the two rods 56 as mentioned above.

FIG. 3.0 shows the preferred embodiment having two hinges and one connecting device 72. If an application requires a plurality of hinges the connecting device/hinge orientation as displayed in FIG. 3.0 would be repeated with several connecting devices axially aligned with the respective lobes of several successive hinges. In this particular application one would have to use the two piece version of the connecting device 72 by having a single rod 56 running the entire width of all of the hinges and individual sleeves 80 being placed over the rod 56 and between each set of hinges. Also, the lever 70 would necessarily be attached to the top of all of the self locking latches and the lever/self locking latch orientation displayed in FIG. 3.0 would likewise repeat itself.

The invention 10 can be easily assembled, by placing the main portions of the hinges into the devices to be connected. In FIG. 5 and FIG. 6 the invention is used in conjunction with a crutch 52. The invention 10 is disposed within the four poles 30, 32, 84 and 86 of the crutch 52. A handle 48 is in the middle of the crutch 52. FIG. 5 displays the invention 10 in its closed position for easy storage and/or transportation. FIG. 6 displays the invention 10 in its open or engaged position. If desired the two halves of the crutch can be attached to each other through a locking mechanism. For example, an elastic based string 60 can be attached to the handle 48 and be used to secure the bottom half of the crutch to the top half of the crutch.

In the example of the crutch 52, engaging and disengaging the invention 10 is easy and can be accomplished with a single hand. To engage the invention 10, and thus open up the crutch 52, one need only grab the handle 48 and allow the bottom half of the crutch to drop down by the force of gravity or other force. As the bottom half of the crutch reaches full extension the self locking latches 16 will pivot allowing the connecting lobes to engage the respective recesses and thus engage the hinge assembly resulting in a strong connection and thus a sturdy crutch.

The specific manner in which the hinge assembly engages is as follows. As the two hinge portions pivot together the connecting lobe 34 will come in contact with the leading edge 78 of the connection portion 24 of the second hinge portion 14. In the preferred embodiment the surface of the leading edge 78 is rounded and bottom surface of the connecting lobe 34 is rounded. The rounded portions of the connection lobe 34 and leading edge 78 in combination with the spring actuated pivoting self locking latch 16 work in unison such that the force used to bring the hinge portions to their respective engaged position is sufficient to allow the connecting lobe 34 to engage the leading edge 78, roll over the leading edge 78, run along the top of the connecting portion 24 and finally come to rest into the recess 36 to thus engage the invention. The pivoting action of the self locking latch 16 allows the connecting lobe 34 to move in the manner mentioned. Also, the spring 42 maintains a constant pressure on the self locking latch 16 during this process and thereby providing a smooth flow of movement of the connection lobe 34 and no unnecessary movement by the self locking latch 16. Also, the spring 42 in combination with pivoting lobes 44, 64, and 66 allows the self locking latch 16 to pivot as necessary. Although it is not necessary but one may wish to manually pivot the self locking latch 16 by pressing down on the lever 70 with the finger of one's hand. Once engaged the bottom half of the crutch is axially aligned with the top half of the crutch.

To disengage the hinge assembly, and thus close the crutch, one need only grab the connecting device 72 with the fingers of one's hand and then press down on the lever 70 with the thumb of that same hand. In the alternative one could just apply pressure to the lever 70 with a finger from one's hand. Regardless of the method chosen, the downward movement of the lever 70 will cause the self locking latches to pivot and thereby cause the respective connecting lobes to release from the respective recesses allowing the bottom half of the crutch to release freely from the top half of the crutch. The individual now simply turns the crutch in such a manner to allow the lower half of the crutch to pivot toward and rest next to the top half of the crutch. If the individual wishes he or she may use the aid of gravity to help the lower half of the crutch pivot towards the top half of the crutch. The lower half of the crutch can be secured to the top half of the crutch in a variety of ways, one of which would be an elastic based string 60 attached to the handle 48.

The specific manner in which the hinges disengage is as follows. The downward movement of the lever 70 causes the spring 42 to compress and thus the self locking latch 16 to pivot on pin 46 resulting in the connecting lobe 34 exiting the recess 36 sufficiently so that the invention 10 is disengaged. In the preferred embodiment the spring 42 is designed to be sufficiently depressed to allow the connecting lobe 34 to exit the recess 36 a sufficient distance so that the connecting portion 24 does not hinder the connecting lobe's 34 ability to release from the second hinge portion 14. For ease of operation, the top of the recess 36 is rounded and in combination with the rounded surfaces of the leading edge 78 and connecting lobe 34 allows the connecting lobe 34 to easily exit the recess 36 and roll over the connection portion 24. Although this arrangement is not necessary as in the preferred embodiment the spring 42 can be pressed sufficiently enough to allow the connecting lobe 34 to pass over the connecting portion 24 without interference, the invention 10 is designed in this manner just in case a user for some reason does not fully depress the spring 42 sufficiently and thus needs the rounded surfaces of the connecting lobe 34, connecting portion 24 and the top of the recess 36 to aid in the disengagement, and engagement, of the invention 10.

Once the connecting lobe 34 is disposed in recess 36 and the hinge portions are axially aligned end to end and the invention 10 is engaged. The spring 42 maintains a constant vertical pressure on the self locking latch 16 and therefore keeps the connecting lobe 34 in the recess 36. All the tolerances on all the parts of the invention 10 are sufficiently tight and a secure connection is made locking the hinge portions in place. The invention 10 is designed so that it can be engaged and disengaged with the minimal of force placed on the lever 70.

The self locking latch 16 has two prongs 58 that protrude out of the side of the self locking latch 16. The prongs 58 are designed to provide a stop for the self locking latch 16. When the self locking hinge 16 is engaged, the prongs 58 rest on the top part of the connecting portion 20. The combination of the prongs 58 resting, or stopping, on the top part of the connecting portion 20 and the pressure created by the spring 42 maintain the self locking latch 16 in a secure position and prevents the self locking latch 16 from moving while the engaged invention 10 is in use.

What is claimed is:

1. A Multiple Self Locking Hinge Assembly comprising:

a lever, a connecting device and a plurality of hinges;

where each hinge comprises a first hinge portion, a second hinge portion, a self locking latch and a spring;

where each hinge portion comprises a connecting portion containing lobes designed to pivotally connect the two hinge portions together and a main body portion designed to connect the hinge portion to an object or objects to be hinged together;

where the first hinge portion contains a top part;

where the spring is disposed between the self locking latch and the top part of the first hinge portion;

where said self locking latch is spring actuated, pivotally attached to the top part of the first hinge portion and where the self locking latch contains a main portion and a connecting lobe;

where said connecting lobe is designed to engage a recess in the second hinge portion;

where said engagement of the connecting lobe into the recess of the second hinge portion locks the hinge in its engaged position;

where the axis of the connecting lobe is perpendicular to the axis of the main portion of the self locking latch;

where said lobes of the hinge portions are off set from the center axis of their respective hinge portions thereby providing a means to allow the hinge portions to pivotally move in an 180-degree orientation with respect to each other from a disengaged position to an engaged position;

where the self locking latch contains two prongs designed to provide a stop for the self locking latch;

where said connecting device is axially aligned and connected to the lobes of the hinge portions of the hinges and is designed to allow all hinge portions to pivot on the same axis;

where said lever is connected to all of the self locking latches and is designed to allow all of the self locking latches to be operated in unison;

wherein an individual can disengage the hinge assembly with a single hand from its engaged position by applying pressure by the finger of one's hand on to the lever causing all of the self locking latches to pivot resulting in the connecting lobes disengaging from the respective recesses in the second hinge portions and thus disengaging the hinge assembly;

wherein an individual can engage the hinge assembly with a single hand by allowing the hinge portions to swing into a 180 degree orientation.

2. A Multiple Self Locking Hinge Assembly as in claim 1 where the lever, connecting device, hinge portions and the self locking latches are made of metal.

3. A Multiple Self Locking Hinge Assembly as in claim 1 where the hinge assembly is used in conjunction with crutches.

4. A Multiple Self Locking Hinge Assembly as in claim 1 where the hinge assembly is used in conjunction with walkers.

5. A Multiple Self Locking Hinge Assembly as in claim 1 where the hinge assembly is used in conjunction with golf bag carriages, baby carriages and collapsible tents.

6. A Multiple Self Locking Hinge Assembly as in claim 1 where a plurality of said hinge assemblies are used in conjunction with a poled device so that the device can be folded in multiple sections to minimize the folded length.

7. A Multiple Self Locking Hinge Assembly as in claim 1 wherein an individual can disengage the hinge assembly with a single hand by grabbing onto the connecting device with the fingers of one's hand and then applying pressure by the thumb of the same hand on to the lever causing all of the self locking latches to pivot resulting in all of the connecting lobes disengaging from the respective recesses.

8. A Multiple Self Locking Hinge Assembly as in claim 1 wherein an individual can engage the hinge assembly with a single hand by applying pressure by the finger of one's hand on to the lever causing all of the self locking latches to pivot, then allowing the all hinge portions to swing into a 180 degree orientation and then releasing the pressure on the lever causing the self locking latches to pivot allowing the connecting lobes to engage the respective recesses.

9. A Multiple Self Locking Hinge Assembly as in claim 1 where the connecting device has an exterior surface that is cylindrically shaped.

10. A Multiple Self Locking Hinge Assembly as in claim 1 where the connecting device has an exterior surface that is hexagonal in shape.

11. A Multiple Self Locking Hinge Assembly as in claim 1 where the connecting device has an exterior surface that is octagonal in shape.

12. A Multiple Self Locking Hinge Assembly as in claim 1 where the connecting device has an exterior surface that is square in shape.

13. A Multiple Self Locking Hinge Assembly as in claim 1 where the connecting device consists of a rod and a sleeve.

14. A Multiple Self Locking Hinge Assembly as in claim 1 where the connecting device consists of a rod made from hardened steel and a sleeve made from aluminum.

15. A Multiple Self Locking Hinge Assembly as in claim 1 where the connecting device consists of single piece of material.

* * * * *